United States Patent [19]

Vye

[11] 4,184,165

[45] Jan. 15, 1980

[54] TUNING SYSTEM FOR TOWER ANTENNAS

[75] Inventor: Melvin C. Vye, North Canton, Ohio

[73] Assignee: Stuart Electronics, Akron, Ohio

[21] Appl. No.: 940,216

[22] Filed: Sep. 7, 1978

[51] Int. Cl.[2] ..... H01Q 9/34; H01Q 1/12; H01Q 1/50

[52] U.S. Cl. ..... 343/874; 343/861; 343/890

[58] Field of Search ..... 343/874, 875, 861, 890, 343/891

[56] References Cited

U.S. PATENT DOCUMENTS

| | | | |
|---|---|---|---|
| 2,063,303 | 12/1936 | Evans . | |
| 2,118,429 | 5/1938 | Duttera . | |
| 2,153,768 | 4/1939 | Morrison . | |
| 2,171,256 | 8/1939 | Moullin . | |
| 2,283,619 | 5/1942 | Wilmotte | 343/875 |
| 2,441,086 | 5/1948 | Stinson . | |
| 2,702,345 | 2/1955 | Walter . | |
| 4,001,832 | 1/1977 | Chesneau et al. | 343/874 |
| 4,131,895 | 12/1978 | Robinson | 343/874 |
| 4,145,693 | 3/1979 | Fenwick | 343/861 |

FOREIGN PATENT DOCUMENTS

| | | |
|---|---|---|
| 471235 | 1/1951 | Canada . |
| 945855 | 7/1956 | Fed. Rep. of Germany . |
| 1208199 | 10/1970 | France . |

OTHER PUBLICATIONS

Beaumont, J. T., "Semi-Vertical Trap Aerial...," in Radio Communication, Aug. 1976, pp. 592–593.

Cunningham, E. W., "Shunt Feeding Towers for Operation on the Lower Amateur Frequencies," in QST, Oct. 1975, pp. 22–26.

*Primary Examiner*—Paul L. Gensler

*Assistant Examiner*—Harry E. Barlow

*Attorney, Agent, or Firm*—Frederick K. Lacher; Warren A. Sklar

[57] ABSTRACT

In accordance with the present invention, a single shunt feed mechanism, including a single gamma section and a single impedance matching circuit, is employed to enable an antenna tower as an effective radiator in plural wave length bands without having to alter the upper tie point of the gamma section to the antenna tower. In one embodiment, the shunt feed of the invention enables the antenna tower as an effective radiator in either two of the adjacent bands mentioned, namely the 40 and 80 meter bands or the 80 and 160 meter bands. In accordance with another embodiment of the invention, a single shunt feed mechanism, including a single gamma section, a single impedance matching circuit, and a filter, enables an antenna tower as an effective radiator in all three of the indicated bands.

15 Claims, 3 Drawing Figures

TUNING SYSTEM FOR TOWER ANTENNAS

TECHNICAL FIELD

The present invention relates generally, as indicated, to antennas and, more particularly, to a system that facilitates tuning of tower antennas to multiple wave length bands, thus increasing the versatility of antennas.

BACKGROUND OF PRIOR ART

Conventional grounded antenna towers have mounted on the top, for example, a directional antenna array for radiating (radiating and radiator being used to indicate the radiating and/or receiving of electromagnetic signals) signals at selected relatively high frequencies with wave lengths, for example, on the order of 20, 15 and 10 meters and V.H.F. A coaxial cable from the radio equipment extends along the tower and is connected to the directional array. Sometimes plural cables may be connected to respective directional arrays adapted to selected respective frequencies.

A grounded antenna tower also may be fed an electrical signal and used in conjunction with additional equipment as the radiator for signals having lower frequencies than those to which directional arrays are adapted. Such additional equipment includes a gamma section and impedance matching circuitry. Such equipment, as is known, can adapt a relatively short antenna tower on the order of, for example, 5 meters to about 30 meters in height, for use on the amateur radio bands of 40 meters, 80 meters, or 160 meters, with each having frequencies in ranges of about 7–7.3 MHz., 3.5–4 MHz., and 1.8–2 MHz., respectively. By using such a gamma section and impedance matching circuitry to shunt feed an antenna tower and to thus convert the tower itself to a radiator, even though the tower height may be relatively small, the versatility of the tower is increased.

To shunt feed a tower so as to use the same as a radiator in the 40, 80 or 160 meter wave length bands, a gamma rod or gamma matching section, which may be simply an electrically conductive rod or wire, is mounted in substantially parallel relation to the tower spaced apart a relatively small distance therefrom. The bottom end of the gamma section is connected by impedance matching circuitry to the bottom of the tower, which is grounded, and to a coaxial cable from the radio equipment, which is generally located remotely from the antenna. In the past, the gamma section has been about 4 or 5 meters in length and has had its upper end electrically tied or connected to the tower at a height along the latter that was specifically adjusted for tuning purposes to obtain a signal strength of adequate value.

The purpose of the impedance matching circuitry, such as conventional gamma matching or omega matching circuitry, was to provide about 120 to about 500 pf. capacitance to match the shunt fed radiator with the impedance of coaxial cable coupling the same to the radio equipment. Such coaxial cable typically has an impedance on the order of about 50 ohms. When shunt feeding an antenna tower, it is desirable that the standing wave ratio (SWR) be as close to 1 as possible. Conventional impedance matching circuitry generally can be adjusted with an SWR meter connected in series therewith to obtain such condition.

To the best knowledge of the applicant, in the past, the shunt feeding of an antenna tower was provided to enable the tower as an effective radiator only in a single one of the 40, 80, or 160 meter wave length bands. In one instance, though, the antenna tower was shunt fed with a single gamma section to enable the tower as a radiator in both the 40 and 80 meter bands, but in that instance it was necessary to adjust the height of the upper tie point of the gamma section to the tower in dependence on the particular wave length being utilized. Moreover, in another instance that a shunt fed tower was enabled as a radiator in more than one of the 40, 80 and 160 meter bands, a separate gamma section and impedance matching circuit was used for each respective band.

It would be desirable to be able to utilize a single shunt feed mechanism, i.e. with only a single gamma section and a single impedance matching circuit, to enable an antenna tower as effective radiator in plural wave length bands, such as, for example, the 40 and 80 meter bands or the 80 and 160 meter bands. Moreover, it would be desirable to be able to use a single shunt feed mechanism to enable a single antenna tower as an effective radiator for all three of those bands. Further, it would be desirable to accomplish the foregoing without having to adjust the upper tie point of the gamma section to the antenna tower.

BRIEF SUMMARY OF INVENTION

In accordance with the present invention, a single shunt feed mechanism, including a single gamma section and a single impedance matching circuit, is employed to enable an antenna tower as an effective radiator in plural wave length bands without having to alter the upper tie point of the gamma section to the antenna tower. In one embodiment, the shunt feed of the invention enables the antenna tower as an effective radiator in either two of the adjacent bands mentioned, namely the 40 and 80 meter bands or the 80 and 160 meter bands. In accordance with another embodiment of the invention, a single shunt feed mechanism, including a single gamma section, a single impedance matching circuit, and a filter, enables an antenna tower as an effective radiator in all three of the indicated bands.

It has been discovered that by locating the vertical gamma section relatively far from the antenna tower, for example at a distance of about 65 cm., as compared to the more closely located vertical gamma sections employed in the prior art, and/or by appreciably increasing the magnitude of the capacitance available in the impedance matching circuitry, a single gamma matching section and impedance matching circuit may be employed to enable effective operation of an antenna tower as a radiator in the indicated plural bands. For example, when the vertical gamma section has a length of about 7 meters, is positioned parallel to the antenna tower about 65 cm. spaced therefrom, is mechanically and electrically connected at the top of the gamma section to a parallel height on the tower, and the impedance matching circuit is adjustable for optimum impedance match with the coaxial cable by capacitance up to about 3,000 pf., the shunt feed system enables the antenna tower as an effective radiator in the wave length bands of 80 and 160 meters. Similarly, by reducing the length of the gamma section to about 3.5 meters and effectively adjusting the impedance matching circuit for optimum standing wave ratio, the antenna tower can be enabled as an effective radiator in the wave length bands of 40 and 80 meters. In both cases, a current flow path is provided from the impedance matching circuit via the gamma section, a connecting rod from the upper end of the gamma section to the antenna tower, down through the antenna tower, and back via a support rod coupled to the tower for supporting the impedance matching circuit back to the latter.

A further embodiment of the invention enables the antenna tower as an effective radiator in all three of the 40, 80 and 160 meter bands. In accordance with this embodiment, the shunt feed employed for both the 80 and 160 meter operation is employed, namely the 7 meter length gamma section. However, coupled at about the mid point of the gamma section, i.e. at about 3.5 meters, is a circuit for connection to a parallel height location on the tower. Such circuit includes an LC series resonant circuit tuned, for example, to 7 MHz. Therefore, when the 40 meter wave length radiation is desired, and approximately a 7 MHz. signal is employed, such signal will circulate from the impedance matching circuit, through the lower half of the gamma section and the LC series resonant circuit to the antenna tower, via the antenna tower, and via the lower support back to the impedance matching circuit. However, when the antenna tower is to be utilized in the 80 or 160 meter band at about 3.5 or about 1.8 MHz., respectively, such electrical signal will bypass the LC series resonant circuit and will use the entire length of the vertical gamma section so that operation is as described above for 80 and 160 meter operation.

In accordance with each embodiment of the invention, the only adjustment necessary to effect efficient enabling and tuning of the antenna tower as a radiator in one of plural, e.g. two or three, bands, is via the impedance matching circuit, which preferably is of the omega matching type, to alter the effective capacitance thereof for optimum impedance matching coupling of the shunt fed antenna system with respect to the coaxial cable.

With the foregoing in mind, it is a primary object of the invention to facilitate enabling an antenna tower as an effective radiator in plural bands and, especially, to enable the same for those antenna towers that lack the size and space requirements for a direct feed arrangement.

Another object is to improve the versatility of an antenna tower.

An additional object is to enable an antenna tower as an effective radiator in plural wave length bands, for example, in two or three such bands.

A further object is to enable a single gamma feed system for a shunt fed antenna tower to permit use of the antenna tower efficiently at different wave lengths with minimum adjustment.

Still another object is to enable an existing grounded antenna tower to be used as an effective radiator for dual band or tri-band operation with only a single gamma section and impedance matching circuit without altering the physical connections to the tower.

These and other objects and advantages of the present invention will become more apparent as the following description proceeds.

To the accomplishment of the foregoing and related ends, the invention, then, comprises the features hereinafter fully described in the specification and particularly pointed out in the claims, the following description and the annexed drawing setting forth in detail certain illustrative embodiments of the invention, these being indicative, however, of but several of the various ways in which the principles of the invention may be employed.

DETAILED DESCRIPTION OF INVENTION

Figure 1:
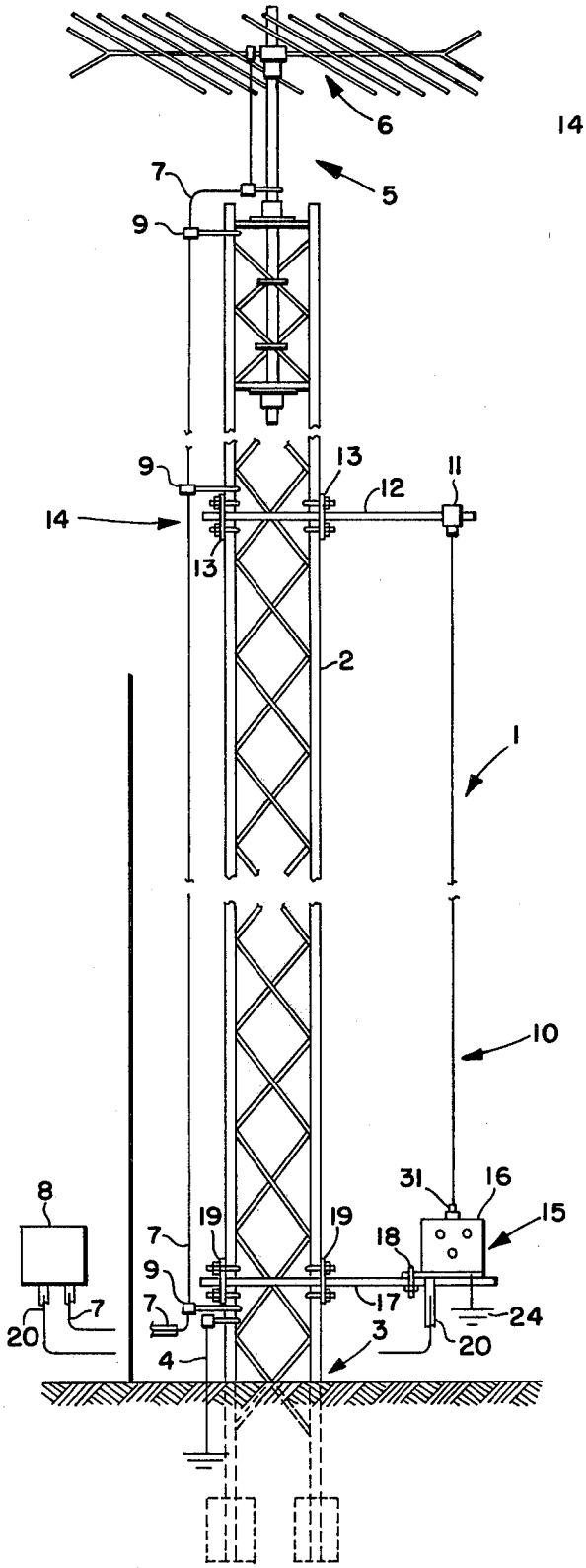
FIG. 1 is an illustration of a grounded antenna tower including the shunt feed and tuning system in accordance with the present invention for enabling the tower as an effective radiator in at least two wave length bands.

Referring initially to FIG. 1, a tuning system 1 in accordance with the present invention is illustrated in association with a conventional antenna tower 2 that is grounded at its base 3 by a grounding rod 4. The antenna tower includes a plurality of electrically conductive and mechanically connected sections that extend upwardly to a height on the order of from about 10 meters to about 30 meters so as to support at the top 5 of the antenna tower conventional directional radiating arrays or antennas 6. A coaxial cable 7 extending up the antenna tower 2 provides electrical coupling between the antenna array 6 and conventional radio equipment 8, which is usually located remotely from the tower 2. The cable 7 may be mechanically supported from the tower by a plurality of insulators 9.

The tuning system 1 is in effect a shunt feed mechanism that enables the tower 2 to radiate in plural wave length bands. The tuning system 1 includes a vertical gamma section 10, such as an electrically conductive wire, rod, pipe, or the like that is positioned in parallel vertical relation with respect to the tower 2. The gamma section 10 is mechanically and electrically connected at its upper end by a clamp 11 to a horizontal rod support 12, for example of aluminum, which is in turn connected by one or more clamps 13 to the tower 2 to provide vertical support for the gamma section while at the same time providing an electrical connection thereof to the parallel height location 14 on the tower 2.

Figure 3:
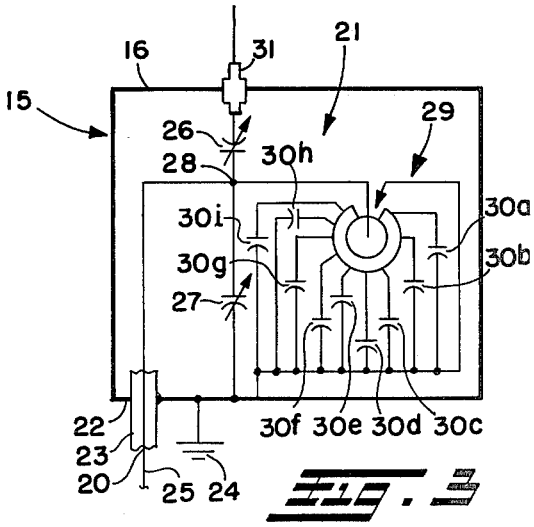
FIG. 3 is a schematic diagram of the impedance matching circuit for the invention.

The tuning system 1 also includes an impedance matching circuit 15, shown in detail in FIG. 3, which is preferably enclosed in a metal, weatherproof housing 16 that is mounted on a further horizontal support 17, such as a further aluminum rod. The support 17 is mechanically and electrically coupled by one or more clamps 18 to the impedance matching circuit housing 16 and by one or more clamps 19 for mechanical and electrical connection to the tower 2 proximate the base 3. A further coaxial cable 20 of, for example 50 ohms impedance, is connected to the radio equipment 8 to couple electrical signals between the radio equipment and the shunt feed tuning system 1 of the invention.

The impedance matching circuit 15, as mentioned above, preferably is of the omega matching circuit type as opposed to the gamma matching circuit type, although the latter may be employed, if desired. The omega matching circuit 21 within the housing 16 includes a mechanical and electrical connector 22 for connection with the coaxial cable 20 such that the coaxial cable shield 23 and housing 16 are coupled to ground reference potential, as is indicated at 24. The main center conductor 25 from the coaxial cable is connected to the junction of a pair of variable capacitors 26, 27, each of which has a maximum value of 300 pf. Also connected to the same junction 28 is a progressive shorting switch 29, which provides for selectively connecting from 0 to 9 additional fixed 300 pf. capacitors 30*a*–30*i* in parallel with the variable capacitor 27. The capacitor 27 and the capacitors 30*a*–30*i* are also connected remotely of the junction 28 to the housing 16 which provides an electrical path to the ground reference potential 24. Moreover, the gamma section 10 is mechanically connected to the housing 16 by a feed through insulator 31 and is electrically connected to the capacitor 26 remotely of the junction 28.

It has been discovered that by positioning the gamma section 10 relatively far, say about 65 cm., from the tower 2 and by using a relatively large capacity impedance matching circuit 15, the tuning system 1 enables the antenna tower 2 as an effective radiator in plural wave length bands of, for example, 40 and 80 meters or 80 and 160 meters without additional gamma sections or the need to vary the vertical location of the upper tie point, e.g. via the rod 12 to the antenna tower. In particular, using a vertical gamma section having a 3.5 meter length, the tower 2 may be enabled as a radiator in the 40 or 80 meter band; the capacitors in the impedance matching circuit 15 may be adjusted as noted below to obtain an optimum SWR, depending on whether the antenna is utilized in the 40 meter or 80 meter band. Similarly, by utilizing a vertical gamma section 10 having a length of about 7 meters, the antenna tower 2 may be utilized as an effective radiator at 80 and 160 meter bands with optimum SWR being provided by simple conventional adjustment of the impedance matching circuit 15. Such enablement has been found independent of total antenna tower length in a range of from about 10 meters to about 30 meters in height and it is expected that the tuning system 1 would be similarly effective with antenna towers outside that range.

The capacitor 26 and the switch 29 effectively provide rough tuning and the capacitor 27 provides fine tuning. For tuning the impedance matching circuit 15, then, first, the capcitor 27 is turned to its lowest value. Second, capacitor 26 is adjusted to obtain the lowest standing wave ratio (SWR) as monitored, for example, in conventional manner by a series connected SWR meter. Third, the switch 29 is adjusted to obtain the lowest SWR and, fourth, subsequently the capacitor 27 is adjusted to obtain the lowest SWR. If necessary, these tuning steps, from the second through the fourth steps, can be repeated for optimum tuning to obtain a minimum SWR.

Adjustment of the capacitors within the housing 16 may be effected by externally accessible control knobs that pass into the housing via weatherproof seals. The objective of such weatherproof integrity of the housing 16 is to assure optimum protection for the impedance matching circuit therewithin, although the environment external of the housing 16 may be relatively hostile.

Figure 2:
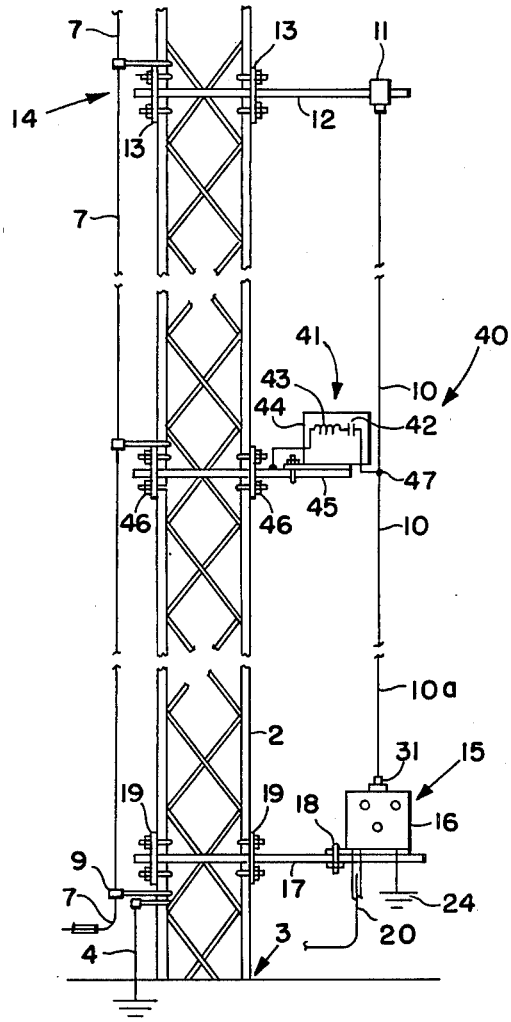
FIG. 2 is a view similar to FIG. 1 illustrating the invention to enable the antenna tower as an effective radiator in at least three wave length bands.

Turning now more particularly to FIG. 2, another embodiment of the tuning system in accordance with the present invention is generally indicated at 40. The elements of the tuning system 40 as illustrated in FIG. 2 that correspond with the elements described above with reference to FIG. 1 are represented by the same reference numerals. However, in accordance with the tuning system 40 it is preferred that the length of the vertical gamma section 10 be approximately 7 meters to provide for enablement of the antenna tower 2 as a radiator in both the 80 and 160 meter wave length bands. The tuning system 40 also includes an LC series resonant tuned filter circuit 41. The tuned circuit 41 is comprised of a capacitor 42 and an inductor 43 which are tuned to a frequency of, for example, about 7 MHz. which is the frequency at which signals are produced in the 40 meter wave length band. The tuned circuit 41 preferably is contained in a weatherproof housing 44 that is mounted on a support 45, such as an electrically conductive aluminum rod in turn mechanically and electrically connected by clamps 46 to the tower 2. One side of the tuned circuit 41 is electrically connected via the rod 45 and the clamps 46 to the tower 2, and the other end of the tuned circuit 41 is electrically connected at a junction 47 to the vertical gamma section 10 at a location approximately half-way along its length, thus being about 3.5 meters above the lower support rod 17 and impedance matching circuit 15.

Preferably the tuned circuit 41 is so highly tuned that it effectively rejects current at the 3.5 and 1.8 MHz. frequencies employed in conjunction with signals in the 80 and 160 meter wave length bands. Therefore, in operation of the tuning system 40 in association with the antenna tower 2 to enable operation of the latter as an effective radiator in the 40 meter wave length band, current from the coaxial cable 20, for example, will flow via the impedance matching circuit, the lower half 10*a* of the gamma section 10, the tuned circuit 41, the rod 45 and clamps 46, the antenna tower 2, and the lower support 17 back to the impedance matching circuit 15 to complete a loop. The frequency of the electrical signals thus radiated or received by the antenna tower 2 will have a frequency on the order of about 7 MHz. that is passed with facility by the tuned circuit 41. Of course, it will be appreciated that the impedance matching circuit 15 would ordinarily be adjusted to provide during such operation optimum SWR condition.

Moreover, for use of the tuning system 40 in connection with the antenna 2 to enable the latter as an effective radiator in the 80 and 160 meter wave length bands, 3.5 or 1.8 MHz. signals are employed. Those signals will be rejected by the tuned circuit 41, and, therefore, their current loop will include the impedance matching circuit 15, the entire length of the vertical gamma section 10, the upper support 12, the antenna tower 2, and the lower support 17 back to the impedance matching circuit, which will be adjusted in conventional manner to obtain preferably an optimum SWR condition.

STATEMENT OF INDUSTRIAL APPLICATION

In view of the foregoing, it will be clear that the tuning systems 1 and 40 in accordance with the present invention enable a grounded shunt fed antenna tower to operate as an effective radiator in plural wave length bands with only a single vertical gamma section and without the need to alter the upper tie point of the latter to the antenna tower.

The embodiments of the invention in which an exclusive property or privilege is claimed are defined as follows:

1. A tuning system for enabling an antenna tower as an effective radiator in plural wave length bands in connection with radio equipment having a plural conductor signal carrier for connection with said antenna tower, comprising:

an electrically conductive gamma section vertically parallel to said antenna tower and horizontally spaced therefrom, connector means for electrically connecting the upper end of said gamma section to said antenna tower at a substantially parallel height location between the top and base of the latter, and capacitive feed means for shunt connecting said plural conductor signal carrier to said antenna tower and gamma section, including adjustable capacitor means for adjustably matching the input impedance of said antenna tower and gamma section relative to the impedance of said plural conductor signal carrier, said gamma section having a length shorter than said antenna tower but otherwise independent of antenna tower length and being spaced from said antenna tower for enabling said gamma section and antenna tower to cooperate in transmitting and receiving signals in plural wave length bands, and said capacitive feed means having a range to tune said antenna tower for efficient operation in at least two bands which are separated in frequency by at least substantially an octave without changing the upper end connection of said gamma section to said antenna tower.

2. The system of claim 1, wherein said gamma section is spaced about 65 cm. from said antenna tower.

3. The system of claim 1, wherein said connector means comprises a rigid rod-like member and means for connecting the same mechanically and electrically in a generally horizontal plane to said antenna tower and to said gamma section.

4. The system of claim 1, further comprising further connector means for supporting said capacitive feed means at a location approximately parallel to the base of said antenna tower and for electrically connecting said capacitive feed means approximately to the base of said antenna tower.

5. The system of claim 1, wherein said capacitive feed means has a variable capacitance with a maximum capacity of at least 3,000 pf.

6. The system of claim 1, wherein said wave length bands are 40 meters and 80 meters.

7. The system of claim 6, wherein the length of said gamma section is about 3.5 meters.

8. The system of claim 1, wherein said bands are 80 meters and 160 meters.

9. The system of claim 8, wherein the length of said gamma section is about 7 meters.

10. The system of claim 1, further comprising filter means coupled between said gamma section and said antenna tower for passing an electrical signal of one wave length band therebetween and rejecting other electrical signal from such passage.

11. The system of claim 10, wherein said filter means comprises an LC series resonant circuit.

12. The system of claim 11, said filter means being connected to said gamma section at a location approximately half-way along the length thereof and to said antenna tower at a height parallel to such connection to said gamma section.

13. The system of claim 12, wherein said gamma section has a length on the order of about 7 meters and said filter means is tuned to a frequency on the order of about 7 MHz. and to reject signals on the order of about 3.5 MHz. and on the order of about 1.8 MHz.

14. The system of claim 13, said filter means including a substantially weatherproof housing, connector means for electrically connecting one side of said filter means to said gamma section, electrically conductive rod-like support means for mechanically supporting said filter means at a height above the base of said antenna tower equal to approximately one-half the vertical length of said gamma section and for electrically connecting said filter means to said antenna tower.

15. The system of claim 13, said filter means being so tuned to pass current therethrough when the tuning system cooperates with said antenna tower in transmitting and receiving signals approximately in a 40 meter wave length band and to impede the passage of current to cause current flow through the entire length of said gamma section when the tuning system cooperates with said antenna tower in transmitting and receiving signals approximately in an 80 meter or 160 meter wave length band.

* * * * *